US008152111B1

(12) United States Patent
Bryan

(10) Patent No.: US 8,152,111 B1
(45) Date of Patent: Apr. 10, 2012

(54) SYSTEM AND APPARATUS FOR INDICATING THE POSITION AND CONDITION OF A SWITCH POINT IN A RAILROAD SWITCH

(76) Inventor: Albert Edwin Bryan, Pensocola, FL (US)

( * ) Notice: Subject to any disclaimer, the term of this patent is extended or adjusted under 35 U.S.C. 154(b) by 0 days.

(21) Appl. No.: 12/927,954

(22) Filed: Nov. 30, 2010

(51) Int. Cl.
*B61L 5/00* (2006.01)

(52) U.S. Cl. ..... 246/220; 246/476

(58) Field of Classification Search ..... 246/1 C, 246/217, 257, 162, 253, 220, 476, 176, 401
See application file for complete search history.

(56) References Cited

U.S. PATENT DOCUMENTS

| | | | | |
|---|---|---|---|---|
| 2,740,041 | A * | 3/1956 | Marcum | 246/220 |
| 5,192,038 | A * | 3/1993 | Ocampo | 246/220 |
| 5,348,257 | A * | 9/1994 | Ocampo | 246/220 |
| 5,531,408 | A * | 7/1996 | Wechselberger | 246/257 |
| 5,806,809 | A * | 9/1998 | Danner | 246/220 |
| 6,164,601 | A * | 12/2000 | Scheer et al. | 246/258 |
| 6,588,710 | B1 * | 7/2003 | Taylor | 246/220 |
| 7,191,986 | B2 * | 3/2007 | Achleitner et al. | 246/253 |
| 7,267,304 | B2 * | 9/2007 | Scheer | 246/410 |
| 7,735,784 | B2 * | 6/2010 | Schalk | 246/476 |
| 2008/0179467 | A1 * | 7/2008 | Wagner et al. | 246/220 |
| 2008/0302921 | A1 * | 12/2008 | Schalk | 246/476 |
| 2009/0045297 | A1 * | 2/2009 | Achleitner et al. | 246/220 |

* cited by examiner

*Primary Examiner* — S. Joseph Morano
*Assistant Examiner* — Jason C Smith
(74) *Attorney, Agent, or Firm* — Robert C. Brown

(57) ABSTRACT

A railroad switch point indicator comprising a mounting plate mountable to a railroad switch point, a tubular housing mounted to the mounting plate, a piston slidably disposed in the housing and extendable to variably engage an associated railroad rail, a bias spring operatively connected to the piston for biasing the piston in an axial direction with respect to the housing and the railroad switch point, and a signal mechanism operatively connected to the piston for indicating the positional status of the switch point via an attitude of a signal flag. When the switch point is engaged with a rail, the flag is in a first attitude. When the switch point is disengaged from the rail, the flag is in a second attitude. When the switch point is positioned incorrectly, i.e., damaged, the flag may be in a third attitude intermediate between the first and second attitudes, indicating alarm.

29 Claims, 8 Drawing Sheets

SYSTEM AND APPARATUS FOR INDICATING THE POSITION AND CONDITION OF A SWITCH POINT IN A RAILROAD SWITCH

TECHNICAL FIELD

The present invention relates to railroad switches for directing a train from a first set of rails to a second set of rails; more particularly, to visual indicators for informing a viewer of the positional status of a switch point in a railroad switch; and most particularly, to a system and apparatus for indicating independently the positions and conditions of both switch points in a railroad switch.

BACKGROUND OF THE INVENTION

It is well known in the prior railroad arts to provide a track arrangement including a main track and a side track, each comprising two parallel rails. The main track includes a fixed or through rail and a movable, tapering main switch rail having a main switch point, and the side track includes a fixed or side rail and a movable, tapering side switch rail having a side switch point. A switching mechanism facilitates directing of rolling stock through the switch by moving the movable switch rails to either of a first position or a second position.

In the first switch position, the switch directs trains along the main track by keeping the main switch point separated from the main rail ("open") to allow train wheels to continue along the main rail, in either direction, and keeping the side switch point engaged with the side rail ("closed") to prevent entry into the side track.

In the second position, the switch connects the main track to the side track by keeping the side switch point spaced apart from the side rail, to facilite entry into or exit from the side track, and the main switch point engaged with the main rail, to divert train wheels from continuing along the main rail, in either direction. (A separate arrangement known in the railroad arts as a "frog" cooperates with the switch to provide a fixed crossing for the second main rail and the second side rail at an appropriate distance from the switch mechanism.)

It is known in the prior art to provide a rotatable switch position indicator of the first and second positions, driven by the switch actuator beside the main track. In the first position, the indicator shows typically a green face to an approaching train engineer, indicating that the switch is set for main track travel; in the second position, the indicator shows typically a yellow face to an engineer, indicating that the switch is set for switching between the main track and the side track. In some known railroad systems, red or white is used for the side rail switch point rather than yellow.

As used herein, train travel through a switch in the direction wherein the through rail and the side rail diverge is defined herein as the first direction of travel, known in the railroad art as a "facing-point" movement. The opposite direction wherein the through and side rails converge is defined herein as the second direction of travel, known in the railroad art as a "trailing-point" movement.

It will be seen that in the first or facing-point direction of travel, on a main track entering a switch, the directing of a train is unambiguous, that is, the switch must be set in either main track or side track mode and the train will follow the switch points (when properly aligned and maintained) on the corresponding tracks accordingly.

It will be obvious that in a properly-functioning switch both points cannot be open at the same time, and that such a condition would lead to derailment of a train. Thus, a serious problem can arise when a train approaches a switch from the second direction in either of the possible trailing-point movements, on either the main track or the side track. If a switch is set for main line travel when a train attempts improperly to enter the main track from the side track, the weight and momentum of the train directed onto the wheel flanges will force open the closed side rail switch point by the width of the flange. This is known in the railroad arts as "running through the switch". The main rail switch point typically is also displaced by a similar amount. However, the actuation mechanism is not moved, and the switch indicator still indicates that the switch is properly set for main track travel. Thus, the damaged switch is left in a dangerous state wherein neither switch point is fully engaged with its respective rail. The next engineer attempting to go through this switch will find that both the main rail and the side rail pathways are partially open. A train traveling into the switch on the main track in a trailing-point movement may be able to traverse the switch without derailing. Similarly, another train entering the main track from the side track, also in a trailing-point movement, will probably also be able to traverse the damaged switch. However, because the main and side rails diverge, a train traveling into the switch on the main track in a facing-point movement must become derailed.

Of course, a similar problem exists, for the same reasons and with the same results, when a train making a trailing-point movement on the main track enters a switch set for side track switching. In this case, the main rail switch point will be forced open, and a subsequent train making either a trailing-point movement from the side track or a facing-point movement along the main track will be derailed.

All railroads keep running counts of switch derailments, which are very large causes of lost time and profit, and the prestigious industry-wide Harriman Award is earned by the company having the lowest incidence of derailments.

Known in the art as Human Factors Incidents, derailments are held to be the result of human error, and railroad employees are expected to visually determine that a switch is correctly set and passable before a train enters the switch; however, a switch that has been damaged as just described can be very difficult to recognize from the cab of a moving engine, especially at night or under adverse weather conditions, and even if an engineer can see it he may not be able to stop the train in time. Because the industry assumption is that an engineer a) will be guided by the system of visual signals provided, and b) will not intentionally run through an incorrectly set switch, there is great interest in providing means by which engineers and yard personnel can determine visually from either direction, at a substantial distance and with great accuracy under any weather and lighting conditions, whether a switch is properly set and, preferably, whether a switch has been damaged by a previous inadvertent running through.

There are numerous inventions in the prior art intended to alert railroad personnel to this dangerous situation.

Several patents, such as U.S. Pat. No. 5,806,809 and U.S. Pat. No. 6,588,710, employ magnetic proximity sensors in systems to detect whether a switch point is in proper closed relationship to its respective rail. All such inventions require electric power for operation, either line power or solar storage or battery power, which brings a substantial added cost and risk of failure.

U.S. Pat. No. 7,735,784 is directed to a mechanical indicator system employing a rectangular sleeve disposed on a tie between the switch points and housing a reciprocating slide with reflectors, attached between both switch points, selected reflectors being visible through windows in the sleeve to indicate whether the switch points themselves are set in the main track or side track position.

This prior art system can be easily damaged by being struck by low-hanging air hose couplings between rail cars near the track middle. Further, the indicator windows are disposed relatively low between the rails and thus may not be easily seen from a relatively low angle along the track, especially under snowy conditions. Further still, if an associated switch is run through, the indicator system may also be damaged and subsequently present faulty signals which can lead to a derailment.

What is needed in the art is a simple, mechanical indicator assembly that can show unequivocally and accurately the position of a switch point in relation to its cooperating rail.

What is further needed in the art is a system employing a pair of such indicator assemblies mounted on both switch points of a switch to show the actual position of each switch point well in advance of passage by a train.

What is still further needed in the art is a system employing a plurality of such pairs disposed on sequential switches along a main track in a switching yard to show at a glance the settings and conditions of all the switch points. As used herein, "condition" should be taken to mean whether a switch point is correctly or incorrectly positioned with respect to its associated railroad rail.

It is a principal object of the present invention to prevent switch damage by preventing the inadvertent running through of switches set in the incorrect position.

It is a further and larger object of the invention to prevent train derailments at switches.

SUMMARY OF THE INVENTION

Briefly described, a railroad switch point indicator in accordance with the present invention comprises a base plate mountable to a railroad switch point; a housing attached to the base plate; a piston slidably disposed in an axial bore in the housing and extendable through the base plate to variably engage the side of an associated railroad rail when the base plate is mounted to a switch point; a bias spring operatively connected to the piston for biasing the piston in an axial direction with respect to the housing and the railroad switch point; and a signal mechanism having at least one rotatable component operatively connected to the piston for indicating the positional status of the piston and hence the switch point via an attitude of a movable signal flag.

The piston may be urged in opposite first and second directions within the housing. When the switch point is disengaged from the associated rail, the piston is urged fully in a first direction, positioning the signal flag in a first attitude to indicate such disengagement (switch point is open). When the switch point is engaged with an adjacent railroad rail, the piston is urged fully in a second and opposite direction, positioning the signal flag in a second attitude to indicate such engagement (switch point is closed). When the switch point is positioned incorrectly and intermediately between the engaged position and the disengaged position, as can happen if the switch has been run through and damaged, the signal flag may be in a third and alarm attitude intermediate between the first and second attitudes, indicating that the switch point is improperly positioned, may cause a derailment, and needs immediate adjustment.

In some applications, it can be desirable that the disengaged attitude is shown when the switch point is open by only a fraction of an inch, and the engaged attitude is shown only when the switch point is closed or very nearly closed. In such applications, a switch that has been run through and damaged will show both the main rail switch point flag and the side rail switch point flag in the switch-point-open attitude simultaneously, indicating a dangerous condition of the switch that must be corrected before passage of a train through the switch.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
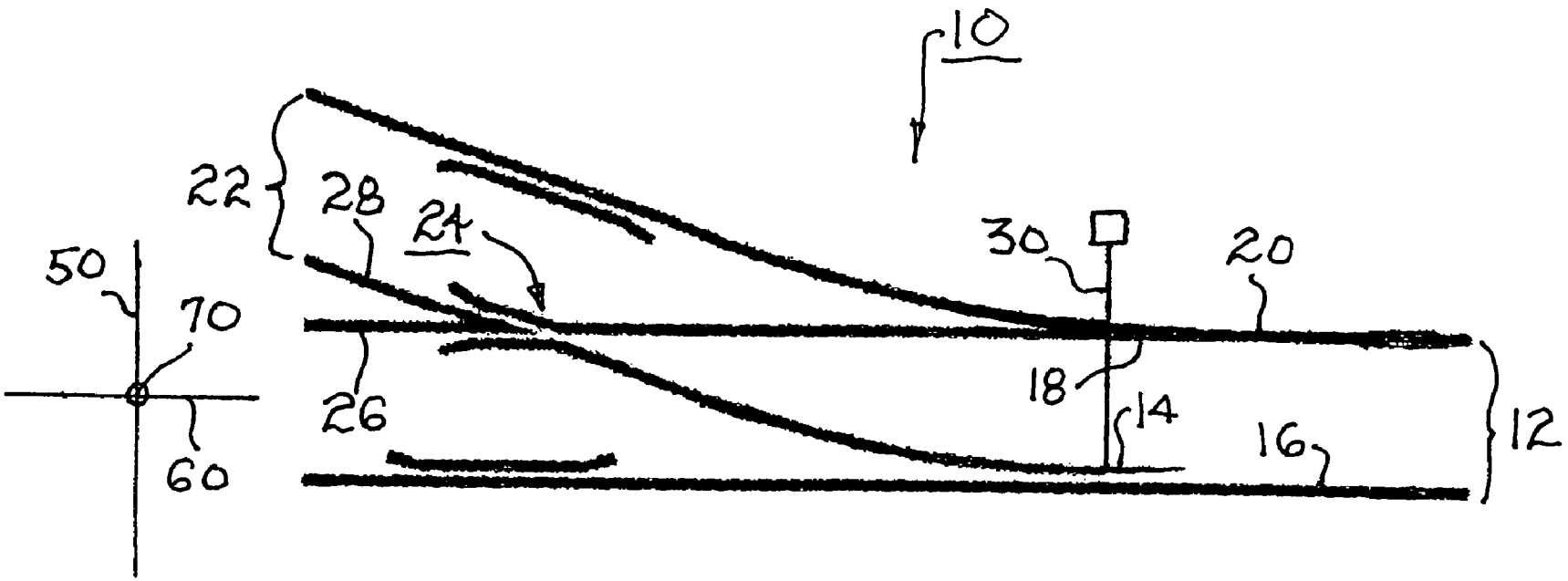
FIG. 1 is a plan view of a typical railroad switch operable between a main track and a side track.

Referring to FIG. 1, a typical railroad switch 10 is shown. In a first switch position, as shown, switch 10 directs trains along the main track 12 by keeping main switch point 14 separated from the main rail 16 ("open") to allow train wheels (not shown) to continue along main rail 16, in either direction, and keeping side switch point 18 engaged with side rail 20 ("closed") to prevent entry into side track 22.

In a second and alternative position (not shown), switch 10 connects main track 12 to side track 22 by keeping side switch point 18 spaced apart from side rail 20, to facilite entry into or exit from side track 22, and main switch point 14 engaged with main rail 16, to divert train wheels from continuing along main rail 16. (A separate arrangement 24 known in the railroad arts as a "frog" cooperates with switch 10 to provide a fixed crossing for second main rail 26 and second side rail 28 at an appropriate distance from the switch mechanism 30.)

It is seen that a train making a trailing-point movement from side track 22 into switch 10 when set for main track travel as shown in FIG. 1, i.e., running through the switch, must force open side switch point 18 from side rail 20, by bending and damaging mechanism 30, in order to pass through the switch. The opposite train wheels will be forced to jump over main switch point 14 onto main rail 16. Switch 10 will be left damaged, with both switch points open.

Similarly, when switch 10 is set in the side track position, a train making a trailing-point movement from main track 12 into switch 10 must force open main switch point 14 from main rail 16 in order to pass through the switch. The opposite train wheels will be forced to jump over side switch point 18 onto side rail 20. Again, switch 10 will be left damaged, with both switch points open.

Figure 1A:
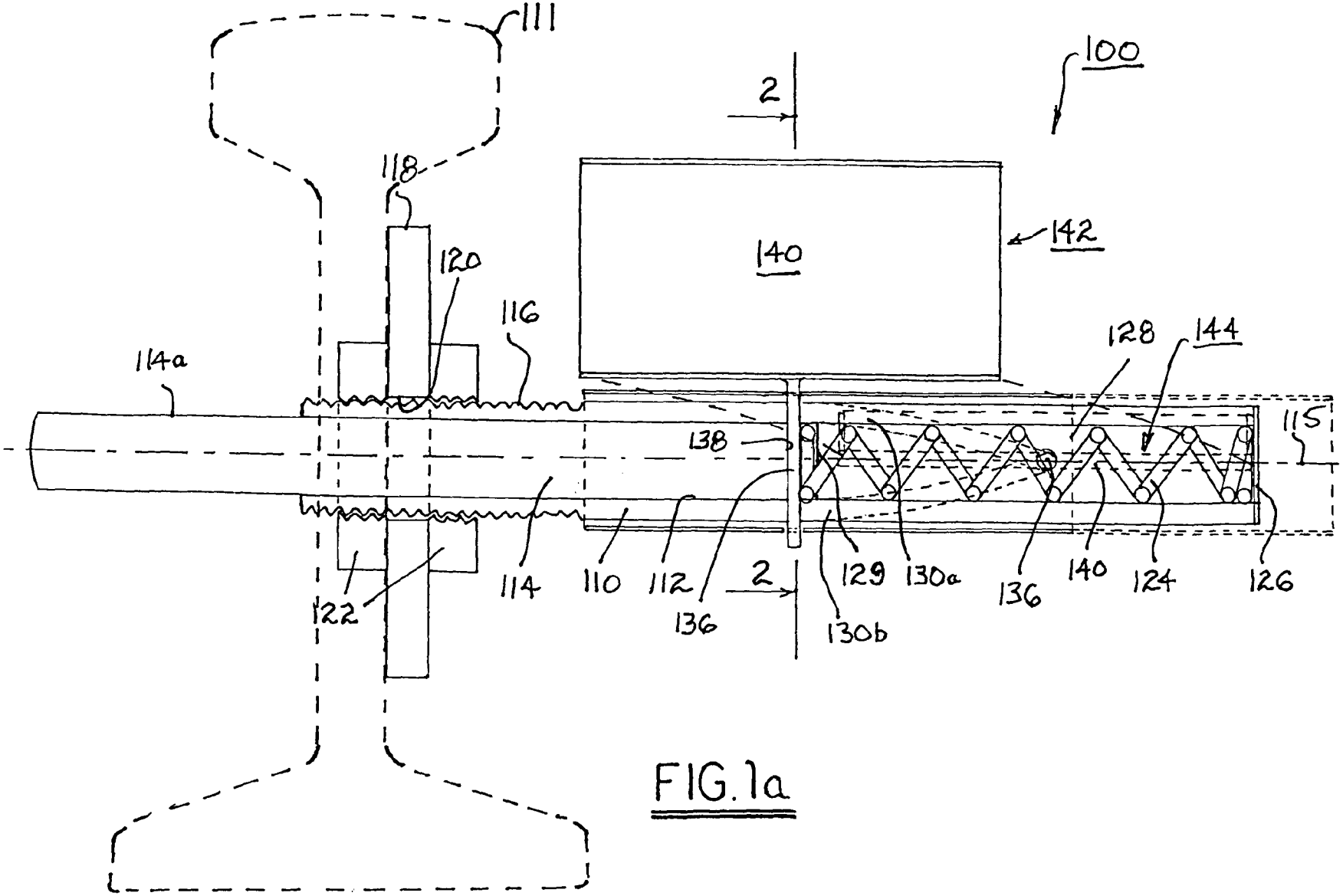
FIG. 1*a* is an elevational longitudinal cross-sectional view of a first embodiment of a railroad switch point indicator assembly in accordance with the present invention, mounted to a railroad switch point and showing the mechanism in both first and second positions, and the signal flag in both first and second attitudes.
Figure 2:
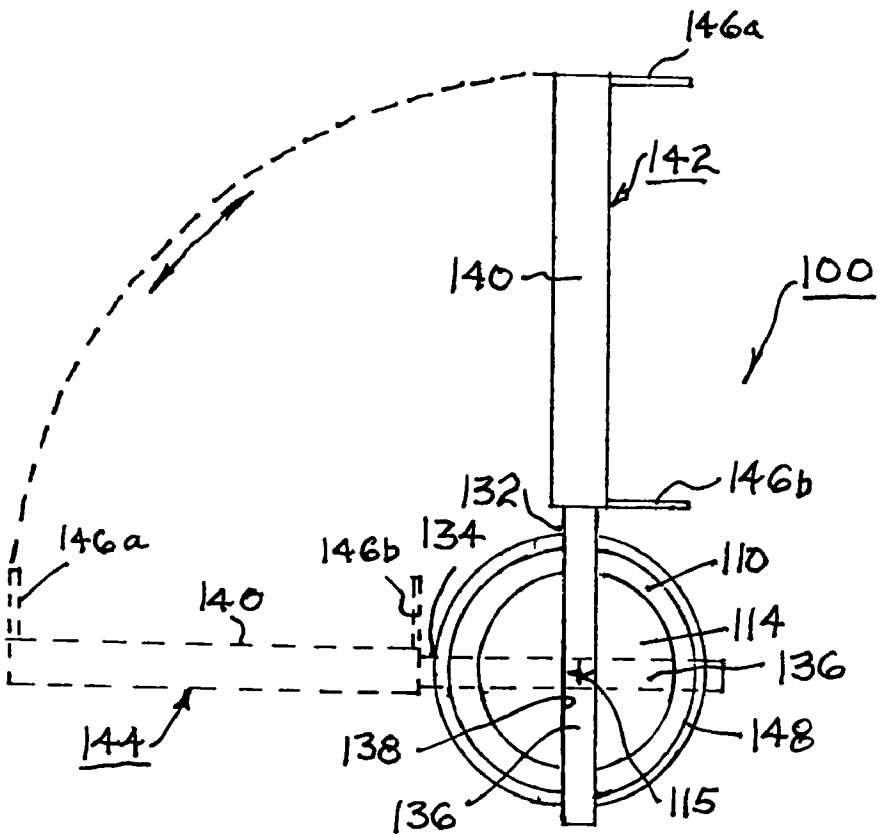
FIG. 2 is a transverse cross-sectional view taken along line 2-2 in FIG. 1*a;*

Referring to FIGS. 1*a* and 2, a first embodiment 100 is shown of a railroad switch point indicator assembly in accordance with the present invention, for mounting to a railroad switch point 111. Embodiment 100 comprises a longitudinal cylindrical housing 110 having a smooth cylindrical bore 112 for receiving a reciprocable piston 114. Preferably, housing 110 is male threaded 116 along an end portion thereof to facilitate mounting to an indicator base plate 118 via a base plate bore 120 and locking nuts 122. (Alternatively, bore 120 may be female threaded (not shown), obviating the need for one of nuts 122.) This arrangement permits adaptation of indicator assembly 100 to various opening gaps of various railroad switches to which indicator assembly 100 may be mounted for use, by which adaptation all such switches may be made to provide an identical stroke of piston 114 in bore 112. Piston 114 is urged to the position shown in FIG. 1*a* (first position) by spring 124 which is captured within bore 112 between piston 114 and housing end plate 126. When a switch point (not shown) to which indicator assembly 100 is mounted is closed against an associated railroad rail (not shown), piston 114 is displaced along its longitudinal axis 115 to travel point 128 (second position), thereby compressing spring 124. When the switch point subsequently is opened from engagement with the rail, spring 124 returns piston 114 to its initial position 129.

Figure 3:
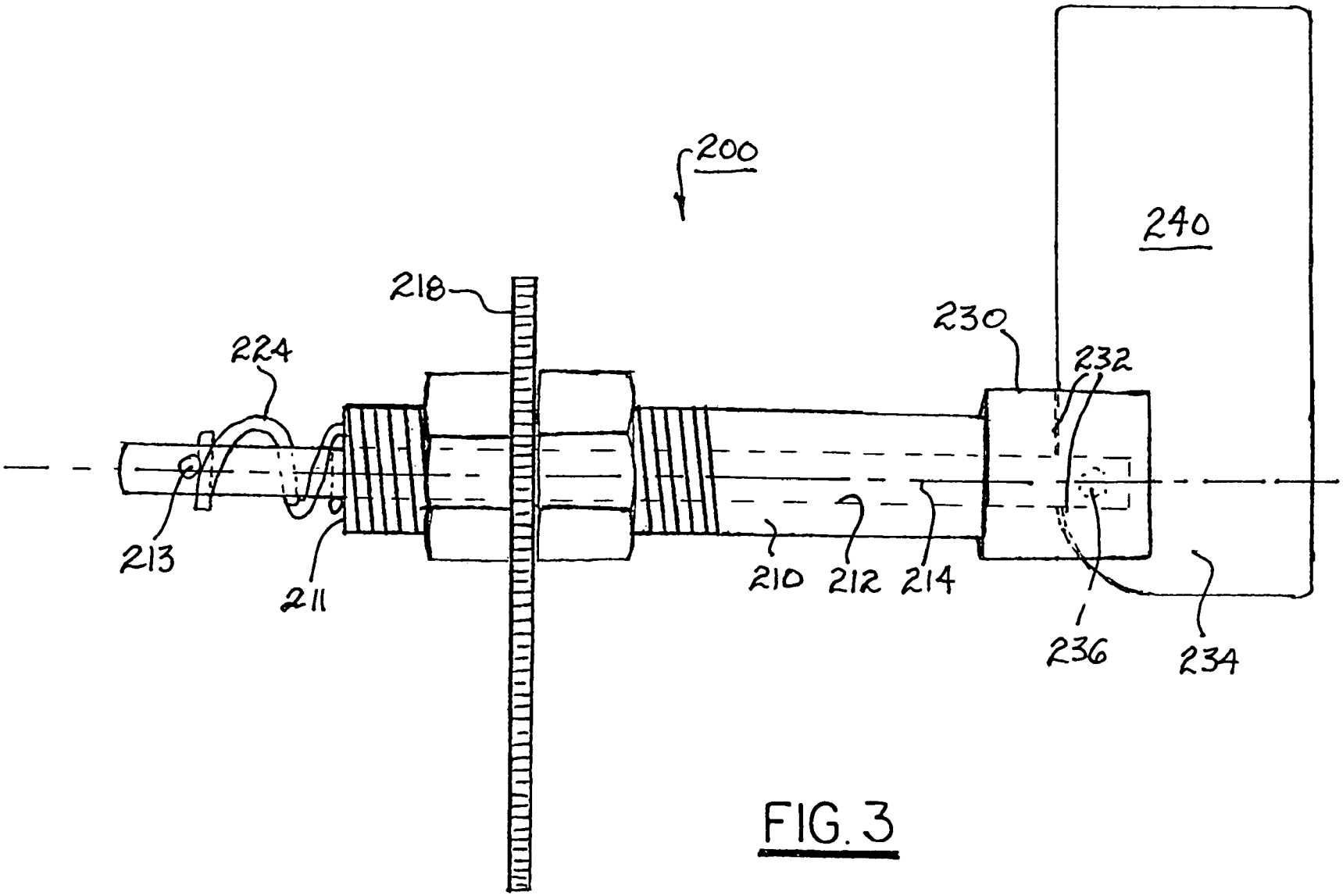
FIG. 3 is a side elevational view of a second embodiment in accordance with the present invention, showing the flag in the first attitude.

It will be obvious to one of ordinary skill in the art that in an alternative embodiment of embodiment 100, spring 124 may be captured on piston end 114*a* outside of housing 110 by compressing the spring and securing it to piston end 114*a* via a pin inserted through the piston end, e.g., such an arrangement is shown in FIG. 3 for second embodiment 200.

Housing 110 is provided with at least one helical slot 130 that begins in a radially vertical position 132 and is rotated either clockwise or counterclockwise through preferably a 90° central angle of housing 110 to a radially horizontal position 134 over precisely the stroke distance of piston 114. Preferably, two such helical slots 130*a*,130*b* are provided, diametrically opposed. It will be seen that a pin 136 fixed in a transverse bore 138 in piston 114 and extending through opposed slots 130*a*,130*b* will cause piston 114 to be rotated 90° over the duration of its stroke. Longitudinal axis 115 thus defines a first Cartesian axis 50 (FIG. 1) of rotation in accordance with the present invention. When indicator 100 is correctly mounted to a switch point, first axis 115 is horizontally transverse of the railroad track.

Alternatively, piston 114 may be bent 90° to form pin 136 integral with piston 114.

A signal flag 140 fixed to pin 136 is displayed vertically in a first attitude 142 to indicate correct disengagement of the switch point from the associated rail. When the switch is closed and piston 114 is stroked, pin 136 and flag 140 are rotated 90° about first axis 115 to a second attitude 144, indicating correct engagement of the switch point with the associated rail.

Preferably, signal flag 140 is provided with first and second flanges 146*a*,146*b* extending orthogonally from the surface edges thereof, which flanges serve to shield from view the upper reflective surface of signal flag 140 from the low-angle perspective of an approaching railroad engine when signal flag 140 is in second attitude 144, ensuring that the flag surface cannot be seen and thus mislead.

Signal flag 140 preferably is provided with a highly reflective surface on both sides to make it readily visible from a distance in either direction along a railroad track. When indicator 100 is used on a main rail switch point, signal flag 140 must be colored green in accordance with railroad industry standard; when indicator 100 is used on a siding rail switch point, signal flag 140 must be colored differently, as described below.

In a further refinement (not shown), optionally signal flag 140 may be electrically illuminated by any of various known illumination means and methods, either on signal flag 140 itself or shined onto signal flag 140.

To shield slots 130*a*,130*b* and pin 136 from the weather, preferably a cylindrical sliding cover 148 attached to pin 136 is provided around housing 110. Cover 148 thus reciprocates and rotates with pin 136 and piston 114.

Figure 4:
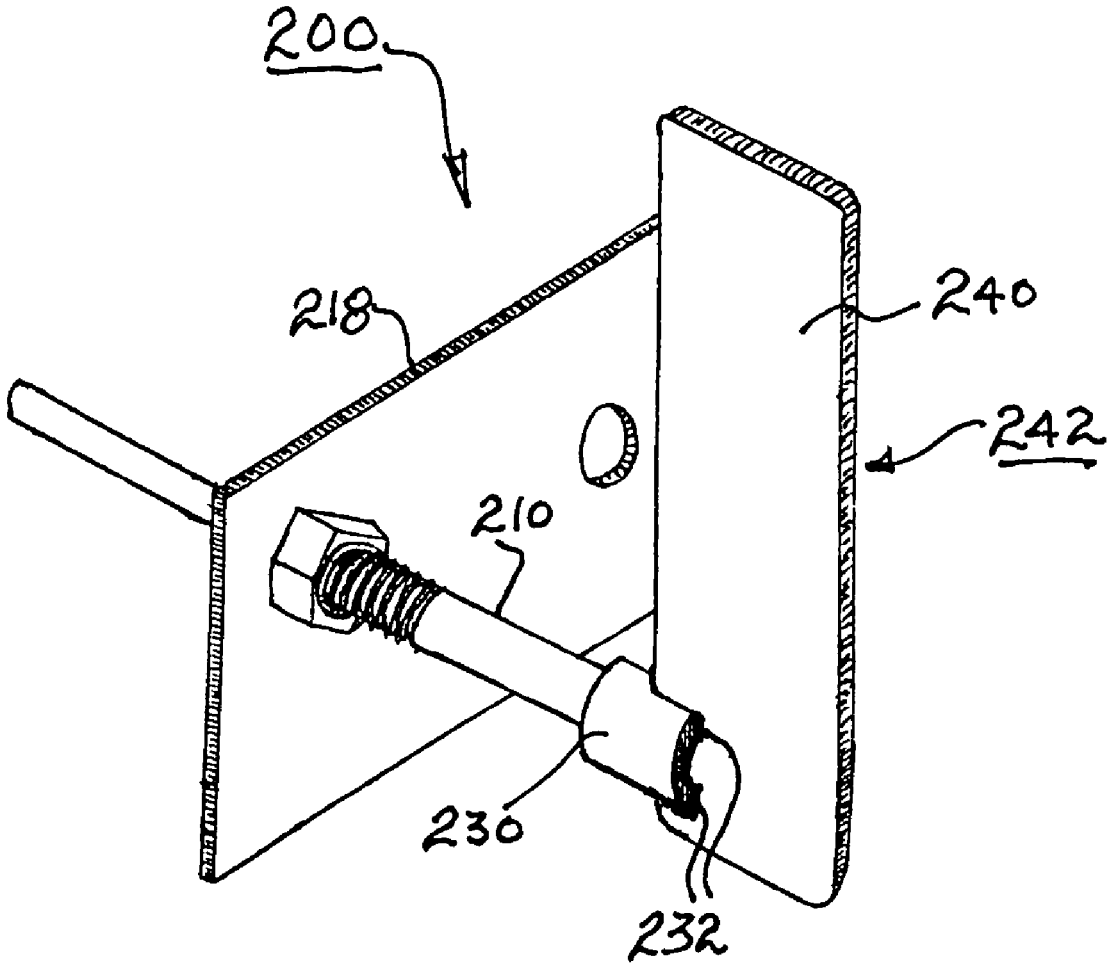
FIG. 4 is a first isometric view of the embodiment shown in FIG. 3.
Figure 5:
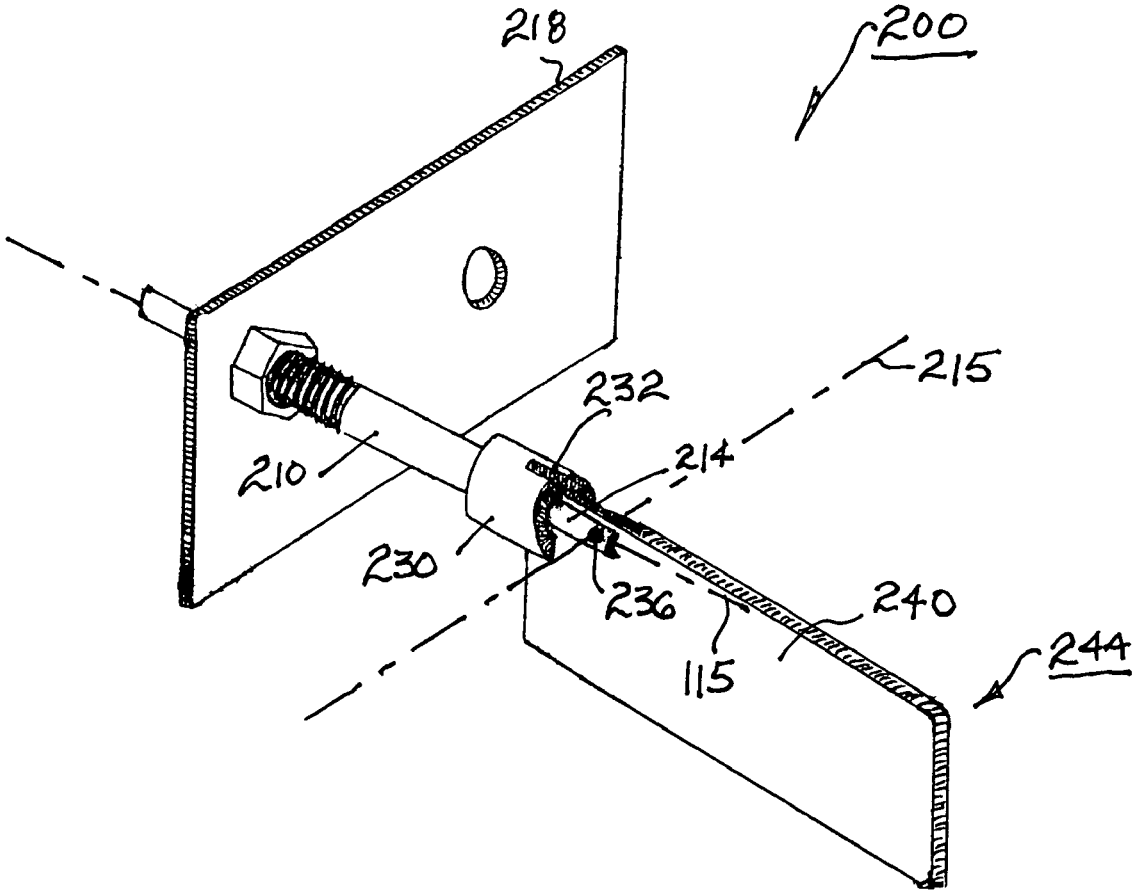
FIG. 5 is a second isometric view of the embodiment shown in FIG. 3, showing the flag in the second attitude.

Referring now to FIGS. 3 through 5, a second embodiment 200 of a railroad switch point indicator assembly in accordance with the present invention is shown. Embodiment 200 comprises a longitudinal cylindrical housing 210 having a smooth cylindrical bore 212 for receiving a reciprocable piston 214. Preferably, housing 210 is male threaded and mounted to base plate 218 as described above for embodiment 100. Piston 214 is urged to the position shown in FIG. 3 (first position) by coil spring 224 which is captured between a first end 211 end of housing 210 and a pin 213 disposed in a traverse bore in piston 214. When a switch point (not shown) to which indicator assembly 200 is mounted is closed against an associated railroad rail (not shown), piston 214 is displaced along its longitudinal axis 215, thereby compressing spring 224. When the switch point subsequently is opened from engagement with the rail, spring 224 returns piston 214 to its initial position.

Housing 210 is provided with a cylindrical housing extension 230 that may be a separate part attached thereto as by threaded connection. Extension 230 includes a vertical slot 232 for receiving a tab 234 rotatably connected to an end of piston 214 as by a rivet or pin 236. Tab 234 may support a separate signal flag (not shown) or may itself be a signal flag 240 as shown in FIGS. 3-5.

In operation, when the switch point is open, the piston is urged fully to the left (first position) by spring 224, as in FIG. 3, thereby seating side 241 of signal flag 240 against the bottom of vertical slot 232. Signal flag 240 is displayed vertically in a first attitude 242 to indicate correct disengagement of the switch point from the associated rail, as shown in FIG. 4. When the switch is closed and piston 214 is stroked to its second position, signal flag 140 is forced outwards in slot 232 and rotates by gravity about axis 215 parallel to second Cartesian axis 60 (FIG. 1) orthogonal to first Cartesian axis 50 to a second attitude 244, indicating correct engagement of the switch point with the associated rail, as shown in FIG. 5. (Note: spring 224 is omitted from FIGS. 4 and 5.)

Figure 6:
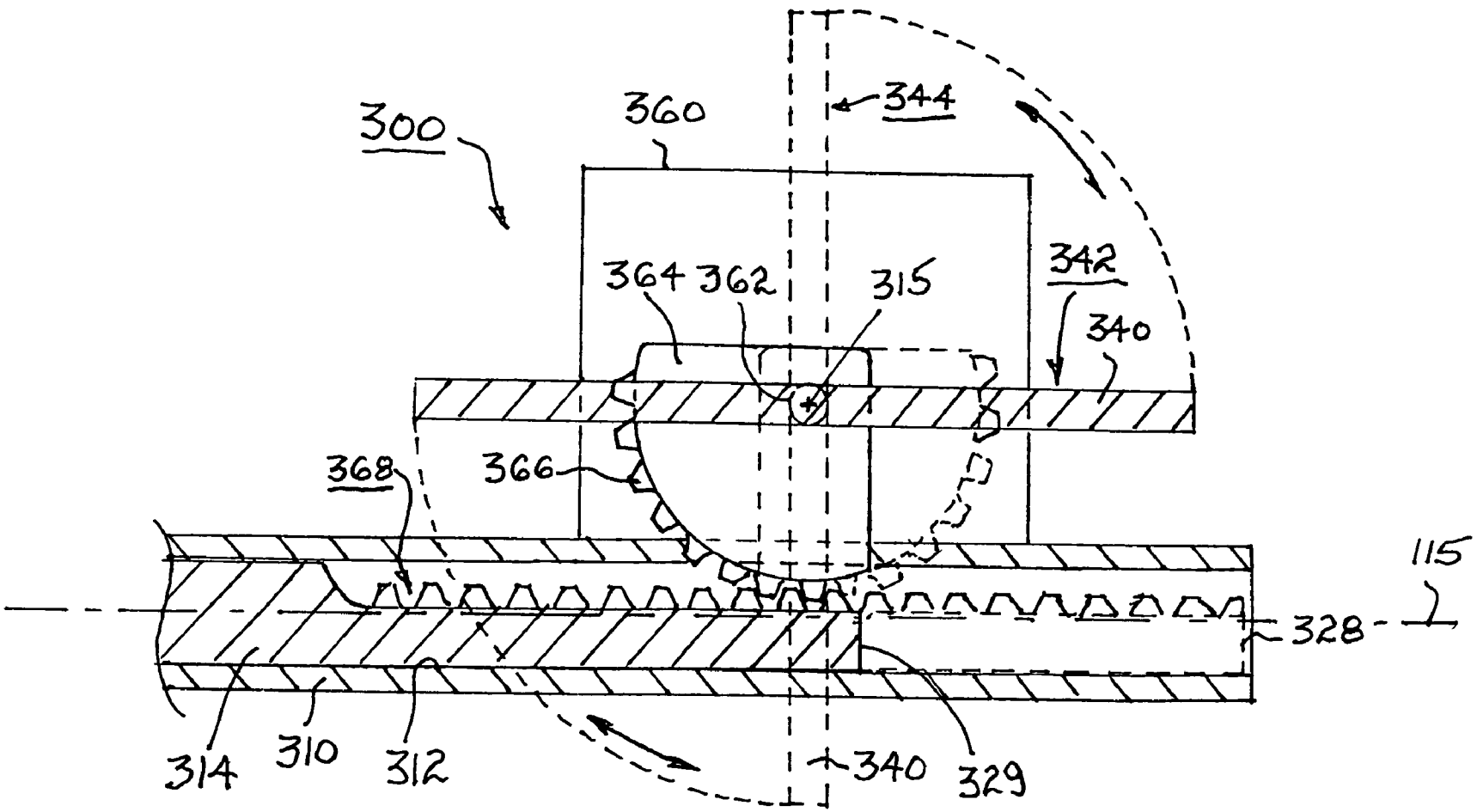
FIG. 6 is a cross-sectional plan view of a third embodiment in accordance with the present invention.

Referring now to FIG. 6, a portion of third embodiment 300 of a railroad switch point indicator assembly in accordance with the present invention is shown; for brevity, the base plate and mounting means are omitted but should be considered as being similar to apparatus shown for embodiments 100,200.

Embodiment 300 comprises a longitudinal cylindrical housing 310 having a smooth cylindrical bore 312 for receiving a reciprocable piston 314. Preferably, housing 310 is male threaded and mounted to a base plate substantially as described above for either of embodiments 100,200. Piston 314 is urged to the position shown in FIG. 6 (first position 329) by a coil spring substantially as described above for either of embodiments 100,200. When a switch point (not shown) to which indicator assembly 300 is mounted is closed against an associated railroad rail (not shown), piston 314 is displaced along its longitudinal axis 315 to second position 328, thereby compressing the coil spring. When the switch point subsequently is opened from engagement with the rail, the coil spring returns piston 314 to its initial position 329.

A mounting bracket 360 is mounted to housing 310. A pin 362, disposed in a bore in bracket 360, rotatably supports a pinion gear segment 364 having teeth 366 over at least a 90° central angle. Piston 314 is provided with a rack gear 368 extending over a portion of the length of the piston and meshing with gear segment 364 such that travel of piston 314 between positions 328 and 329 serves to rotate gear segment 364 either about or with pin 362 through a 90° rotation. Signal flag 340, fixed to pin 362 or gear segment 364, is displayed vertically in a first attitude 342 transversely of an associated railroad rail (not shown) to indicate correct disengagement of the switch point from the associated rail. When the switch is closed and piston 314 is stroked, pin 362 and flag 340 are rotated about axis 315 parallel to third Cartesian axis 70 orthogonal first and second Cartesian axes 50,60 to a second attitude 344 parallel to the associated railroad rail, becoming invisible from the associated track in either direction and thereby indicating correct engagement of the switch point with the associated rail.

Figure 7:
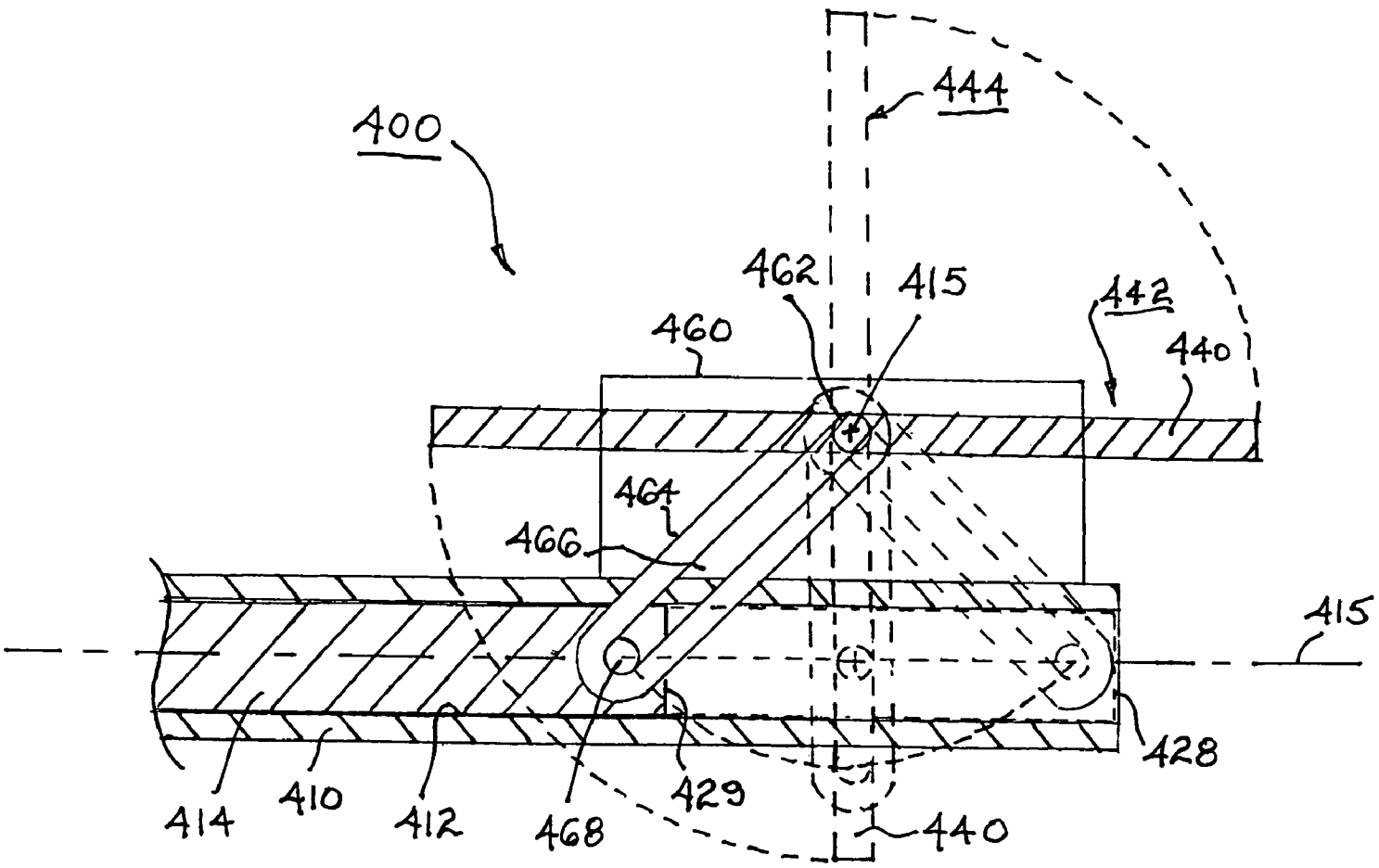
FIG. 7 is a cross-sectional plan view of a fourth embodiment in accordance with the present invention.

Referring to FIG. 7, a portion of an embodiment 400 alternative to third embodiment 300 is shown.

Embodiment 400 comprises a longitudinal cylindrical housing 410 having a smooth cylindrical bore 412 for receiving a reciprocable piston 414. Preferably, housing 410 is male threaded and mounted to a base plate substantially as described above for either of embodiments 100,200. Piston 414 is urged to the position shown in FIG. 7 by a coil spring substantially as described above for either of embodiments 100,200. When a switch point (not shown) to which indicator assembly 400 is mounted is closed against an associated railroad rail (not shown), piston 414 is displaced along its longitudinal axis 415 to position 428, thereby compressing the coil spring. When the switch point subsequently is opened from engagement with the rail, the coil spring returns piston 414 to its initial position 429.

A mounting bracket 460 is mounted to housing 410. A pin 462, disposed in a bore in bracket 460, rotatably supports a pivotable lever arm 464 having a slot 466. Piston 414 is provided with a pin 468 extending into slot 466. Travel of piston 414 between positions 428 and 429 serves to rotate lever arm 464 through a 90° rotation. As in embodiment 300, signal flag 440 fixed to lever arm 464 is displayed vertically in a first attitude 442 transversely of an associated railroad rail (not shown) to indicate correct disengagement of the switch point from the associated rail. When the switch is closed and piston 414 is stroked, lever arm 464 and flag 440 are rotated about third axis 415 to a second attitude 444 parallel to the associated railroad rail, becoming invisible from the associated track in either direction and thereby indicating correct engagement of the switch point with the associated rail.

Note that in each embodiment 100,200,300,400, correct operation of the associated switch point with respect to its associated railroad rail is indicated by one or the other extreme position of the piston and its associated signal flag. It is a very important advantage of the present invention that any of these embodiments will show that a switch has been damaged by a run through. Because a run-through leaves the switch point in an intermediate position between fully open and fully closed, which unacceptable open spacing may be as little as a fraction of an inch, the stroke of the piston will be stopped somewhere between the extremes x28 and x29 described above. The result will be that the signal flag may be stopped in a third attitude intermediate between first and second correct attitudes x42 and x44 described above, which intermediate attitude is an alarm attitude indicating that the switch point is improperly positioned and can cause derailment of the next train to pass through the switch.

In some applications, it can be desirable to adjust the action of each of the switch point indicators such that the switch-open attitude of the signal flag is displayed when the switch point is open by as little as a fraction of an inch, as can occur when the switch has been run through and damaged. In such case, the signal flags of both switch points will show a switch-open attitude. Since in a properly-functioning switch, both flags are never visible (switch-open attitude) at the same time, an engineer seeing both flags of a switch will know immediately that the switch is damaged and a derailment can occur.

A railroad switching yard comprising first and second railroad switch point indicators on all the switches defines a system for reducing railroad derailments at switches. Each switch is provided with two switch point indicators, one indicator having a green signal flag being mounted on the main-rail switch point, and the other indicator having a different colored signal flag being mounted on the side-rail switch point. In various railroad systems, the known side track indicator may be yellow, red, or white. An engineer entering the switching yard on a main track can tell immediately and at a glance a) whether all switch points are in proper adjustment and repair, and b) which side tracks if any are enabled, indicated by the green flag visible and the differently colored flag not visible. Likewise, an engineer entering a main track from a side track can tell a) whether the switch points ahead are in proper adjustment and repair, and b) whether the switch is properly set to enable such entry and thereby avoid a destructive run-through of an incorrectly set switch. With diligent attention by all engineers and switch yard personnel to switch point indicator positions and conditions, all derailments resulting from running through incorrectly-set switches can be avoided, at great savings to the railroad company and improved personnel safety.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A railroad switch point indicator assembly mountable to a first railroad switch point of a railroad switch having first and second switch points, comprising:

a) a base plate;

b) a tubular housing mounted to said base plate;

c) a piston slidably disposed in said housing and extendable through said first railroad switch point at a first end thereof to variably bear upon an associated fixed railroad rail at a plurality of piston lengths of extension;

d) a bias spring operatively connected to said piston for biasing said piston in an axial direction with respect to said housing and said first railroad switch point; and e) a signal mechanism operatively connected to said piston for indicating the positional status of said first railroad switch point with respect to said associated fixed railroad rail via an attitude of a signal flag therein, wherein a portion of said signal mechanism is rotatable about one of three Cartesian axes of said indicator assembly, and wherein one of said first and second railroad switch points is a main rail switch point and the other of said first and second railroad switch points is a side-rail switch point, and wherein when said first railroad switch point is disengaged from said associated fixed railroad rail, said piston is urged by said spring to a first length of extension, positioning said signal flag in a first attitude to indicate such disengagement, and wherein when said first railroad switch point is engaged with said associated fixed railroad rail, said piston is urged by said spring to a second length of extension, positioning said signal flag in a second attitude to indicate such engagement.

2. A railroad switch point indicator in accordance with claim 1 wherein a first of said Cartesian axes coincides with a longitudinal axis of said piston.

3. A railroad switch point indicator in accordance with claim 2 wherein a second of said Cartesian axes is horizontally transverse of said first Cartesian axis when said housing is mounted to said first railroad switch point.

4. A railroad switch point indicator in accordance with claim 3 wherein a third of said Cartesian axes is vertically transverse of said first and second Cartesian axes when said housing is mounted to said first railroad switch point.

5. A railroad switch point indicator in accordance with claim 4 comprising an element attached to said housing and rotatable about said third axis and being operatively connected to said piston.

6. A railroad switch point indicator in accordance with claim 5 wherein said signal flag is a planar element and is orthogonal to a longitudinal axis of said piston when said signal flag is in said first attitude.

7. A railroad switch point indicator in accordance with claim 5 wherein said signal flag is a planar element and is parallel to a longitudinal axis of said piston when said signal flag is in said second attitude.

8. A railroad switch point indicator in accordance with claim 5 wherein said signal flag is fixed to said element.

9. A railroad switch point indicator in accordance with claim 5 wherein said element is a sector wheel.

10. A railroad switch point indicator in accordance with claim 9 wherein said sector wheel is a pinion gear, and wherein said piston is provided with a meshing rack.

11. A railroad switch point indicator in accordance with claim 9 wherein said sector wheel is provided with a radial slot, and wherein said piston is provided with a pin disposed for sliding in said slot during travel of said piston.

12. A railroad switch point indicator in accordance with claim 3 wherein said signal mechanism comprises:

a) first and second longitudinal slots formed at a second end of said housing; and b) a tab attached to said piston and rotatable around said second Cartesian axis, wherein an edge of said tab is urged by said piston against the bottoms of said slots to place said tab in a first position when said piston is urged to said first length of extension, and wherein said tab is urged by said piston away from said bottoms of said slots when said piston is urged to said second length of extension.

13. A railroad switch point indicator in accordance with claim 12 wherein said tab is said signal flag.

14. A railroad switch point indicator in accordance with claim 12 wherein said signal flag is attached to said tab.

15. A railroad switch point indicator in accordance with claim 12 wherein said housing comprises:

a) a main body portion; and b) a housing attachment containing said slots.

16. A railroad switch point indicator in accordance with claim 2 wherein said signal mechanism comprises:

a) a helical slot formed in said tubular housing; and b) a fixed pin disposed in a transverse bore in said piston and extending radially through said helical slot to cause said piston to be rotated about said first axis when said piston is urged longitudinally of said housing.

17. A railroad switch point indicator in accordance with claim 16 wherein said helical slot is a first helical slot, further comprising a second helical slot formed in said housing diametrically opposite from said first helical slot.

18. A railroad switch point indicator in accordance with claim 16 wherein said signal flag is fixed to said pin.

19. A railroad switch point indicator in accordance with claim 16 further comprising a sliding cover disposed on said housing.

20. A railroad switch point indicator in accordance with claim 1 wherein the color on at least one side of said signal flag is green.

21. A railroad switch point indicator in accordance with claim 1 wherein the color on at least one side of said signal flag is selected from the group consisting of red, yellow, and white.

22. A railroad switch point indicator in accordance with claim 1 wherein at least a portion of said signal flag comprises illuminating means.

23. A system for reducing railroad derailments at a switch between a main track and a side track, comprising first and second railroad switch point indicators, each being formed in accordance with claim 1 and being mounted to a main-rail switch point and a side-rail switch point, respectively, of said switch, wherein said signal flag of said main-rail switch point indicator is green, and wherein said signal flag of said side-rail switch point indicator is a color selected from the group consisting of red, yellow, and white.

24. A system in accordance with claim 23, wherein, when said main-rail switch point and side-rail switch point are correctly set for train passage through said switch on said main track, said signal flag of said main-rail switch point indicator is visible and said signal flag of said siding-rail switch point indicator is invisible, and wherein, when said main-rail switch point and side-rail switch point are correctly set for train passage through said switch between said main track and said side track, said signal flag of said main-rail switch point indicator is invisible and said signal flag of said siding-rail switch point indicator is visible.

25. A system in accordance with claim 24 wherein, when either of said main-rail switch point and said side-rail switch point is incorrectly set, said signal flag of said main-rail switch point indicator and said signal flag of said side-rail switch point indicator are both visible.

26. A method for indicating and determining independently the position and condition of each of first and second switch points in a railroad track switch when said switch is set in a desired position, comprising the steps of:

a) mounting a first switch point indicator on said first switch point, wherein a first signal flag is capable of being displayed in a first attitude indicating that said first switch point is open and a second attitude indicating that said first switch point is closed;

b) mounting a second switch point indicator on said second switch point, wherein a second signal flag is capable of being displayed in a first attitude indicating that said second switch point is open and a second attitude indicating that said second switch point is closed; and c) examining whether said first and second signal flags are in their correct respective attitudes for said desired switch position, wherein at least one of said first and second switch point indicators includes a base plate; a tubular housing mounted to said base plate; a piston slidably disposed in said housing and extendable through said railroad switch point at a first end thereof to variably bear upon an associated fixed railroad rail at a plurality of piston lengths of extension; a bias spring operatively connected to said piston for biasing said piston in an axial direction with respect to said housing and said first railroad switch point; and a signal mechanism operatively connected to said piston for indicating the positional status of said first railroad switch point with respect to said associated fixed railroad rail via an attitude of a signal flag therein, wherein a portion of said signal mechanism is rotatable about one of three Cartesian axes of said indicator assembly, and wherein when said railroad switch point is disengaged from said associated fixed railroad rail, said piston is urged by said spring to a first length of extension, positioning said signal flag in a first attitude to indicate such disengagement, and wherein when said railroad switch point is engaged with said associated fixed railroad rail, said piston is urged by said spring to a second length of extension, positioning said signal flag in a second attitude to indicate such engagement.

27. A method in accordance with claim 26 comprising the further step of creating an alarm when either of said first and second signal flags is not in its correct respective attitude for said desired switch position.

28. A method in accordance with claim 26 comprising the further step of creating an alarm when both of said first and second signal flags are in said first attitude.

29. A method in accordance with claim 26 comprising the further step of creating an alarm when both of said first and second signal flags are in said second attitude.

* * * * *